US012290731B2

(12) United States Patent
Mason et al.

(10) Patent No.: US 12,290,731 B2
(45) Date of Patent: May 6, 2025

(54) ARM POSITION MONITOR FOR A GOLF SWING

(71) Applicants: Bradley R. Mason, Rancho Santa Fe, CA (US); Jeffrey T. Mason, Valley Center, CA (US)

(72) Inventors: Bradley R. Mason, Rancho Santa Fe, CA (US); Jeffrey T. Mason, Valley Center, CA (US)

( * ) Notice: Subject to any disclaimer, the term of this patent is extended or adjusted under 35 U.S.C. 154(b) by 0 days.

(21) Appl. No.: 18/119,799

(22) Filed: Mar. 9, 2023

(65) Prior Publication Data

US 2024/0299821 A1 Sep. 12, 2024

(51) Int. Cl.
*A63B 69/36* (2006.01)

(52) U.S. Cl.
CPC ..... *A63B 69/3608* (2013.01)

(58) Field of Classification Search
CPC ..... A63B 69/36; A63B 69/3608
See application file for complete search history.

(56) References Cited

U.S. PATENT DOCUMENTS 3,861,688 A * 1/1975 Butler ..... A63B 69/3608 473/214
3,884,478 A * 5/1975 Buzan ..... A63B 69/3608 473/214
5,108,103 A * 4/1992 Rilling ..... A63B 69/3608 473/214
11,065,522 B1 * 7/2021 Begley ..... A63B 69/0059
2004/0142756 A1 * 7/2004 Oury ..... A63B 69/3608 473/205
2015/0011338 A1 * 1/2015 Russotti ..... A63B 69/00 473/422

FOREIGN PATENT DOCUMENTS

KR 102297583 B1 * 9/2021 ..... A63B 60/46
WO WO-9611040 A1 * 4/1996 ..... A63B 69/0059
WO WO-0200311 A1 * 1/2002 ..... A63B 69/0059

* cited by examiner

*Primary Examiner* — Raleigh W Chiu
(74) *Attorney, Agent, or Firm* — CP LAW GROUP PC; Cy Bates

(57) ABSTRACT

An arm position monitor is provided having a magnetically attractive object, a magnet-coupler connector and a magnet. The magnetically attractive object is adapted to connect to an arm of a user and the magnet is adapted to connect to the same arm or to the other arm via the magnet-coupler connector. When positioned adjacent to one another during a golf swing, the magnet and magnetically attractive object attach to one another. However, if the user's arm substantially deviates from an optimal arm position during the swing, the user applies a detachment force greater than the magnetic attraction force that detaches the magnet from the magnetically attractive object. The arm position monitor alerts the user when this occurs.

19 Claims, 12 Drawing Sheets

ARM POSITION MONITOR FOR A GOLF SWING

FIELD OF THE INVENTION

The present invention relates generally to the sport of golf and more particularly to devices and methods used to improve a golf swing.

BACKGROUND

A fundamental tenet of golf is that a golfer's arms must be properly positioned throughout the golf swing to achieve an optimal swing. One aspect of proper arm positioning is a golfer's ability to maintain the distance between his or her lower arms relatively constant at all times during the swing with only a limited degree of fluctuation. When a golfer is at the address stage of a golf swing, proper positioning of the arms requires both to be straight and fully extended downward with the lower arms forming a "V". The upper arms are pressed tightly against the chest and the elbows are tucked in toward the body so that the points of the elbows face the golfer's respective hipbones while the insides of the elbows face skyward. The lead arm remains straight during the backswing while the trail arm bends progressively more as the golfer approaches the top of the backswing. The lead arm continues to remain straight during the downswing while the trail arm bends progressively less until both arms are straight again just past the point of impact. The arm positions are reversed during the follow-through with the trail arm remaining straight while the lead arm bends progressively more until the follow-through is completed.

In sum, the optimal golf swing requires at least one of the golfer's arms to remain generally straight for the duration of the swing. The elbows and arms should be maintained as close together as possible and the distance between the lower arms should be maintained relatively constant. See Ben Hogan with Herbert Warren Wind, *Ben Hogan's Five Lessons The Modern Fundamentals of Golf*, First Fireside Edition, 1985, Simon & Schuster, Inc., Copyright 1957, which is incorporated herein by reference.

Another aspect of proper arm positioning is a golfer's ability to avoid cupping the lead wrist during the golf swing. If the lead wrist is cupped when the golfer reaches the impact stage of the golf swing, the club face will be open which undesirably results in a slice. If the golfer avoids cupping the lead wrist, the club face is more likely to be square on impact producing a straighter shot.

As such, the present invention recognizes a need for a device and method that alerts a golfer when the golfer's arms are improperly positioned during a golf swing. Accordingly, it is an object of the present invention to provide a monitor that tracks the position of a golfer's arms during a golf swing and alerts the golfer when the arms become improperly positioned during the swing. It is another object of the present invention to provide such a monitor that alerts the golfer of improper arm position during a golf swing by means of a real-time alarm. These objects and others are accomplished in accordance with the invention described hereafter.

SUMMARY OF THE INVENTION

The present invention may be characterized as an arm position monitor including first and second arm couplers, a magnetically attractive object, a magnet-coupler connector and a magnet having a magnetic attraction force. The first arm coupler is connected to the magnetically attractive object and is adapted to connect the magnetically attractive object to an arm of a user. The second arm coupler is connected to the magnet via the magnet-coupler connector which extends a connector length between the magnet and the second arm coupler. The second arm coupler is adapted to connect the magnet to the same arm of the user as the magnetically attractive object or to the other arm of the user. The magnetically attractive object and magnet are positioned adjacent to one another when the first and second couplers are coupled with the respective arms of the user and the arms of the user are maintained in an optimal arm position for a golf swing. When positioned adjacent to one another, the magnet and magnetically attractive object are adapted to releasably attach to one another due to the magnetic attraction force of the magnet. If the user's arm substantially deviates from the optimal arm position during the swing, the user applies a detachment force greater than the magnetic attraction force to the magnet or magnetically attractive object in a direction away from the magnetic attraction force. When this occurs, the magnet is adapted to detach from the magnetically attractive object.

The arm position monitor also preferably includes a magnetically attractive object housing retaining the magnetically attractive object and having a strap retention loop. The first arm coupler is a coupling strap receivable within the strap retention loop. The coupling strap is adapted to encircle the arm of the user, thereby connecting the magnetically attractive object to the arm. The arm position monitor further preferably includes an alarm element adapted to output an alarm when the magnet and magnetically attractive object detach from one another. A preferred alarm is a beep, vibration or light.

In accordance with a preferred embodiment, the magnet-coupler is an external segment of a substantially pliant non-stretchable line and the second arm coupler is adapted to connect the magnet to the other arm of the user than the arm to which the first arm coupler is connected. The arm position monitor preferably further includes a connector housing anchoring an end of the magnet-coupler connector and having a strap retention loop. The second arm coupler is a coupling strap receivable within the strap retention loop. The coupling strap is adapted to encircle the other arm of the user, thereby connecting the magnet to the other arm.

The arms have an arm separation distance during the golf swing and the optimal arm position corresponds to an optimal arm separation distance. The connector length approximates the optimal arm separation distance and the magnet and magnetically attractive object attach to one another when the arms are at the optimal arm separation distance. The magnet and magnetically attractive object detach from one another when the arm separation distance substantially exceeds the optimal arm separation distance.

In accordance with another preferred embodiment, the magnet-coupler connector is substantially rigid. The second arm coupler is a clip adapted to attach to a golf glove worn on the hand of the same arm that is connected to the magnetically attractive object, thereby connecting the magnet to the same arm of the user as the magnetically attractive object.

The present invention may alternately be characterized as an arm position monitor having first and second arm units, a magnetically attractive object, a magnet and a magnet-coupler connector. The first arm unit retains the magnetically attractive object and is adapted for connecting to an arm of a user. The first arm unit preferably has a first arm unit housing to retain the magnetically attractive object. The first arm unit also has a first coupling strap engaging the first arm unit housing and adapted to encircle the arm of the user, thereby connecting the magnetically attractive object to the arm. The second arm unit preferably has a second arm unit housing adapted for connecting to the other arm of the user. The second arm unit also has a second coupling strap engaging the second arm unit housing and adapted to encircle the other arm of the user, thereby connecting the magnet to the other arm.

The magnet-coupler connector is an external segment of a line that is maintained external to the second arm unit housing. The line also has an internal segment maintained internal to the second arm unit housing. The external segment has an external end and the internal segment has an internal end. The magnet is attached to the external end. The magnetically attractive object and the magnet attach to one another due to a magnetic attraction force of the magnet when the magnetically attractive object and the magnet are positioned adjacent to one another.

A reel and a rotation lock are contained in the second arm unit housing. The internal segment is wound around the reel and the internal end is anchored to the reel. The internal segment has an internal segment length and the magnet-coupler connector has a connector length. The connector length is adapted to be set at an optimal connector length approximating an optimal arm separation distance for a golf swing by rotating the reel in one direction to increase the connector length and correspondingly decrease the internal segment length or rotating the reel in an opposite direction to decrease the connector length and correspondingly increase the internal segment length. The rotation lock is adapted to selectively releasably lock the reel against rotation.

In accordance with a preferred embodiment, the magnetically attractive object and the magnet are adapted to detach from one another when an arm separation distance during the golf swing substantially exceeds the optimal connector length. The first arm unit preferably has a first arm unit housing retaining the magnetically attractive object and a microcircuit including a magnetic field detector and an alarm element. The microcircuit is adapted to activate the alarm element when the magnetic field detector detects an absence of a magnetic field proximal to the first arm unit housing due to detachment of the magnetically attractive object and magnet from one another. The alarm element is adapted to output an alarm when activated.

The present invention may also be characterized as an arm position monitor having an arm unit, a magnetically attractive object, a magnet having a magnetic attraction force, a coupler and a substantially rigid magnet-coupler connector extending between and connecting the magnet to the coupler. The arm unit retains the magnetically attractive object and is adapted for connecting the magnetically attractive object to an arm of a user. The coupler is adapted to attach to a golf glove worn on the hand of the same arm that the magnetically attractive object is connected to. As such, the magnet-coupler connector enables the coupler to connect the magnet to the arm of the user. When positioned adjacent to one another, the magnet and magnetically attractive object are adapted to releasably attach to one another due to the magnetic attraction force of the magnet. If the user's arm substantially deviates from the optimal arm position during the swing, the user applies a detachment force greater than the magnetic attraction force to the magnet or magnetically attractive object in a direction away from the magnetic attraction force. When this occurs, the magnet is adapted to detach from the magnetically attractive object.

The arm unit preferably has a coupling strap adapted to encircle the arm and an arm unit housing retaining the magnetically attractive object. The arm unit housing has a strap retention loop receiving the strap, thereby connecting the magnetically attractive object to the arm. The arm unit housing preferably retains a microcircuit that includes a magnetic field detector and an alarm element. The microcircuit is adapted to activate the alarm element when the magnetic field detector detects an absence of a magnetic field proximal to the magnetically attractive object due to detachment of the magnetically attractive object and the magnet from one another. The alarm element is adapted to output an alarm when activated.

BRIEF DESCRIPTION OF THE DRAWINGS

The below-listed drawing figures illustrate one or more embodiments of the present invention by way of example and not by way of limitation. Common reference characters are used among the different drawing figures to indicate the same structural elements.

DETAILED DESCRIPTION OF THE INVENTION

Figure 1:
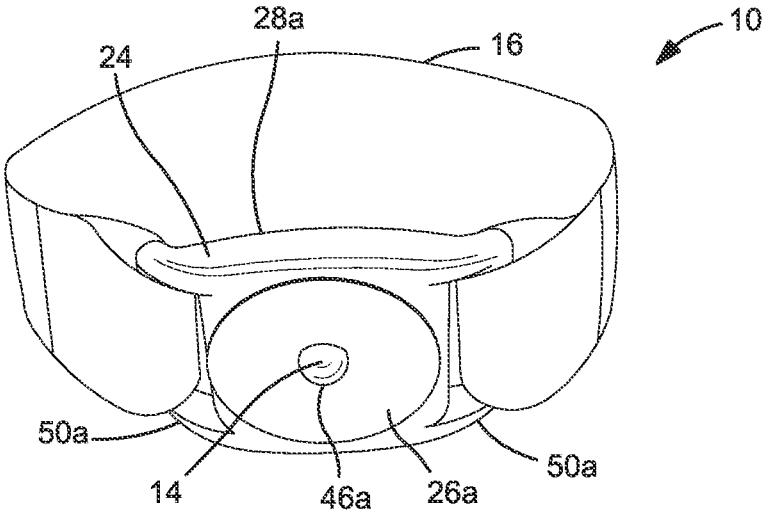
FIG. 1 is a front perspective view of a first arm unit having utility in a first embodiment of an arm position monitor.
Figure 9:
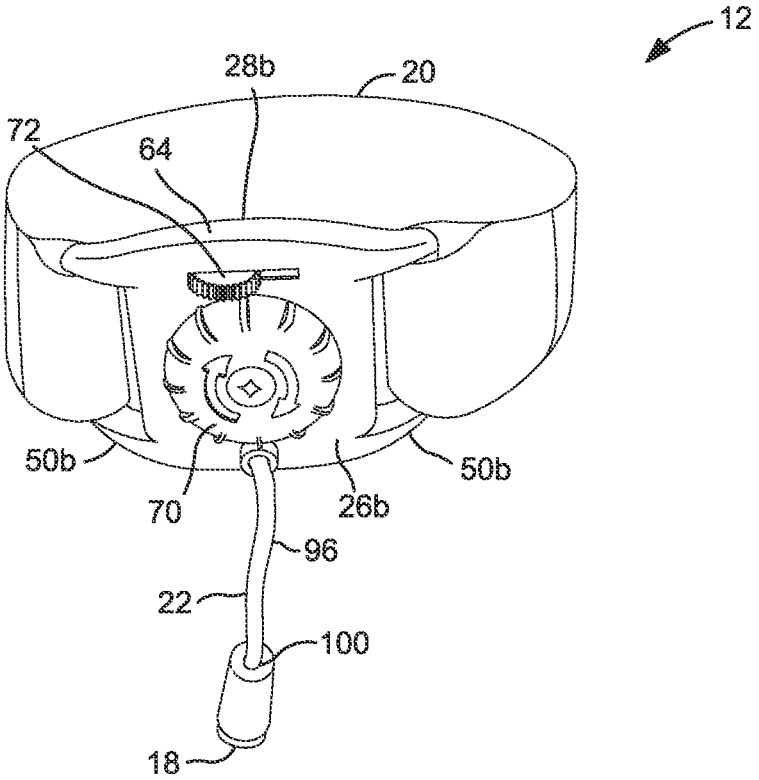
FIG. 9 is a front perspective view of a second arm unit having utility in the first embodiment of the arm position monitor.
Figure 2:
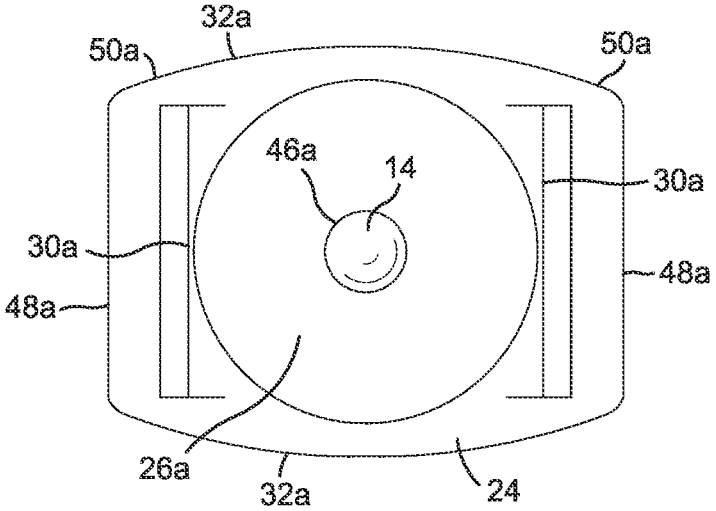
FIG. 2 is a front plan view of the first housing included in the first arm unit shown in FIG. 1.
Figure 3:
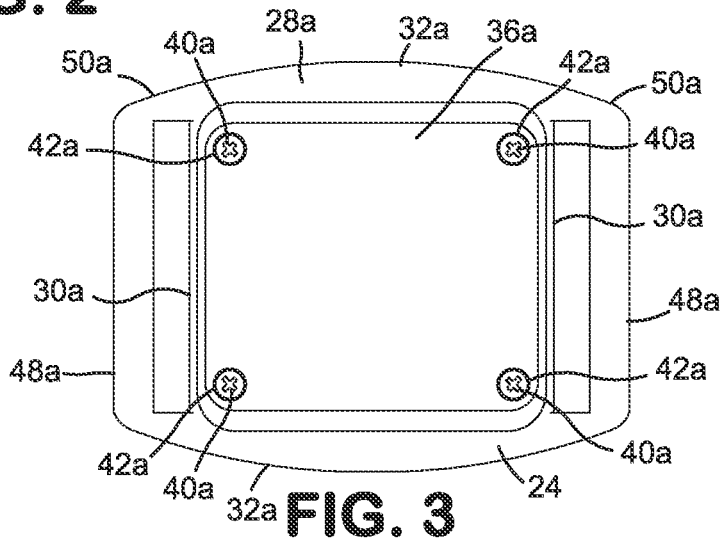
FIG. 3 is a rear plan view of the first housing shown in FIG. 2.
Figure 4:
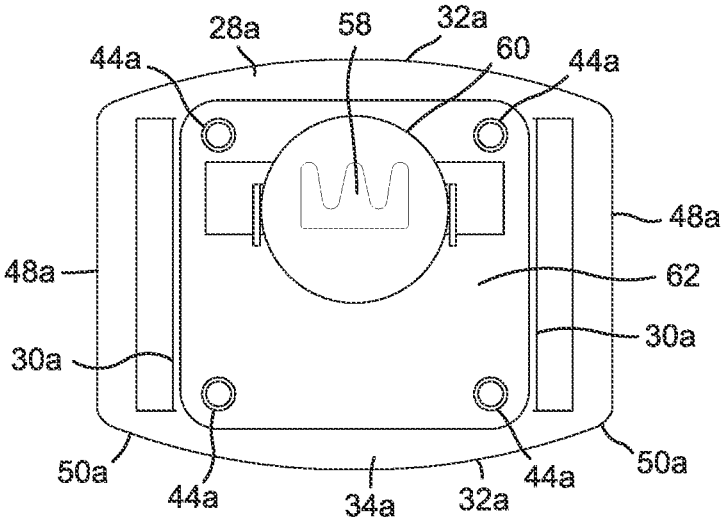
FIG. 4 is a rear plan view of the first housing shown in FIG. 2 with the rear panel removed.
Figure 5:
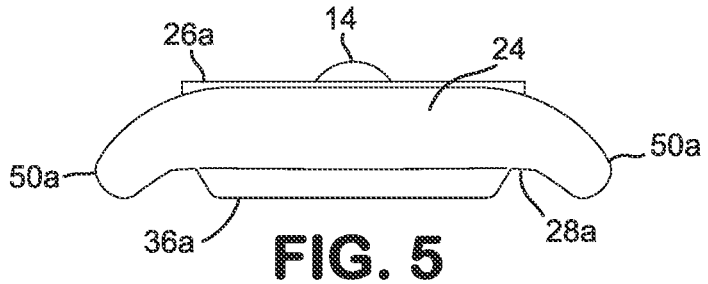
FIG. 5 is an elevation view of the first housing shown in FIG. 2.
Figure 6:
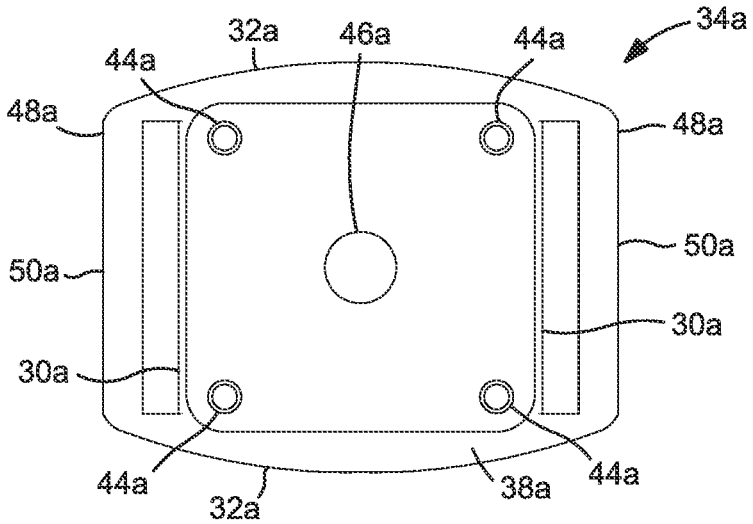
FIG. 6 is a rear plan view of the housing frame included in the first housing shown in FIG. 2.
Figure 7:
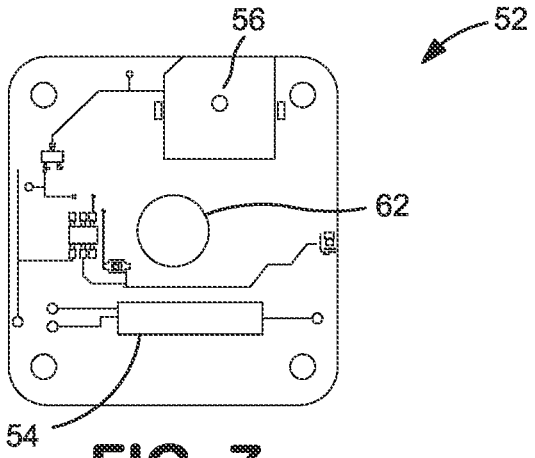
FIG. 7 is a front plan view of the printed circuit board included in the first housing shown in FIG. 2.
Figure 8:
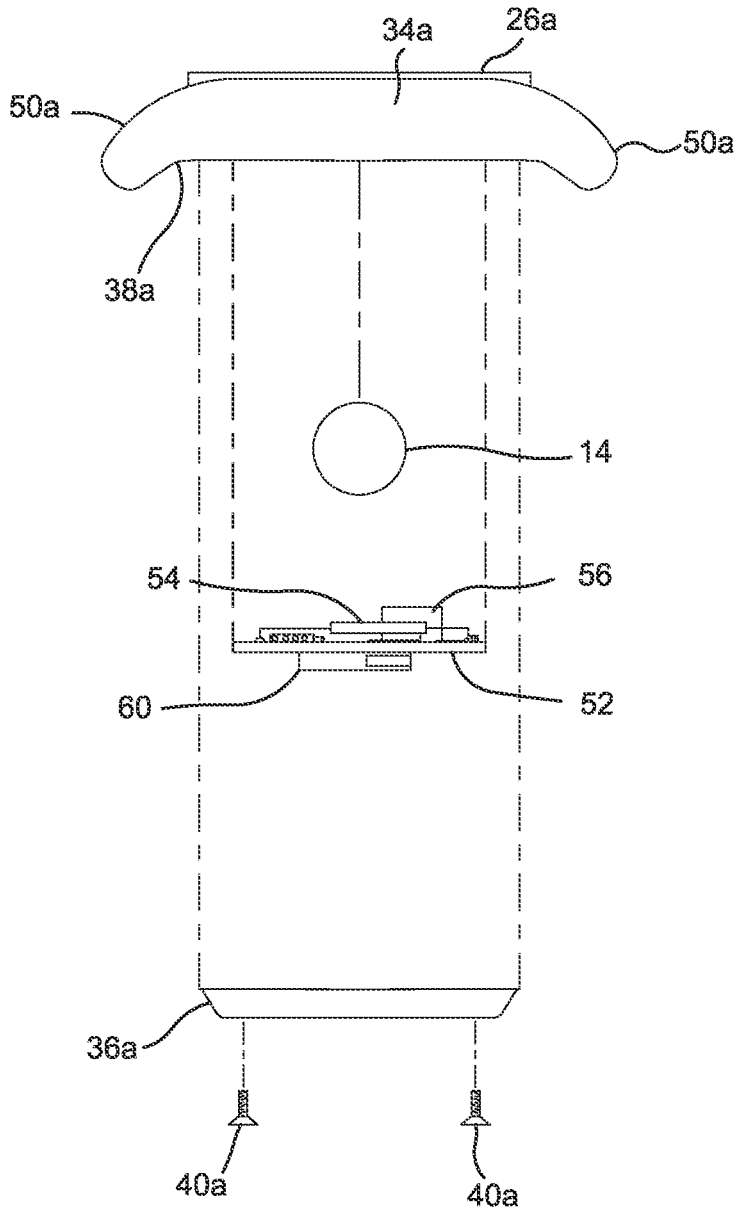
FIG. 8 is an exploded view of the first housing shown in FIG. 2.
Figure 10:
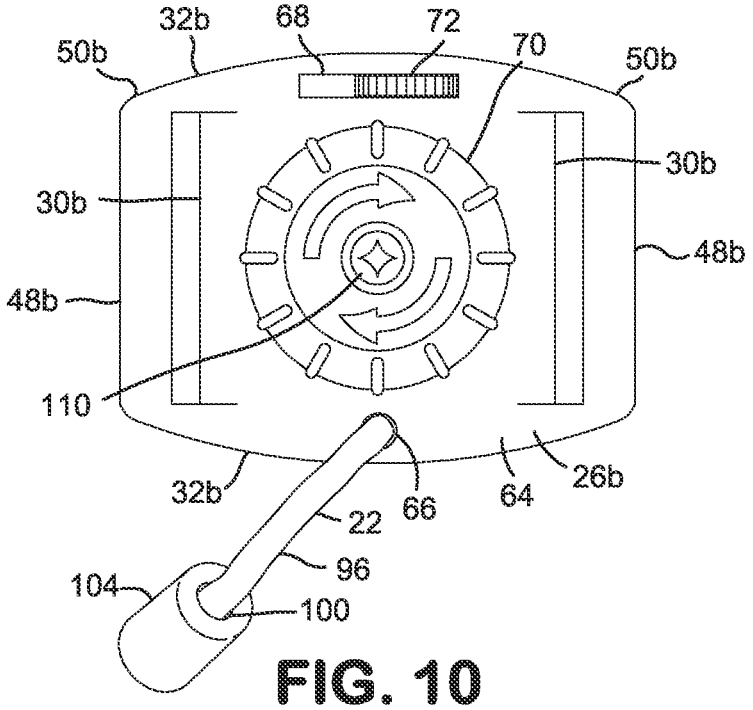
FIG. 10 is a front plan view of the second arm unit.
Figure 11:
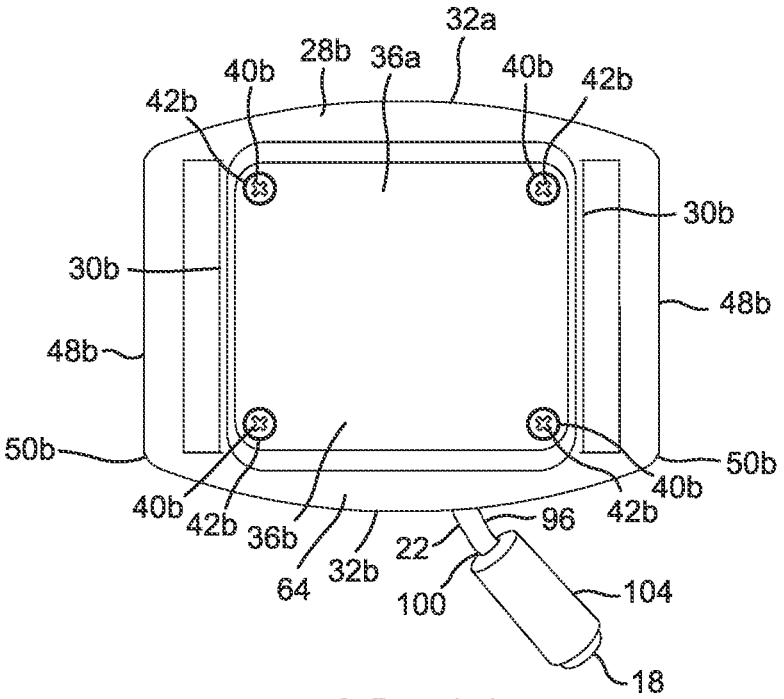
FIG. 11 is a rear plan view of the second arm unit.
Figure 12:
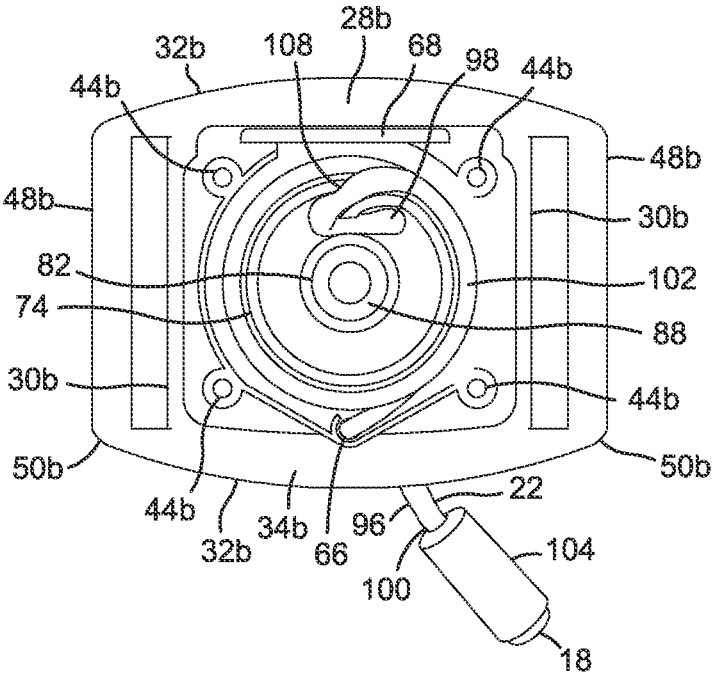
FIG. 12 is a front plan view of an interior of the second arm unit.
Figure 13:
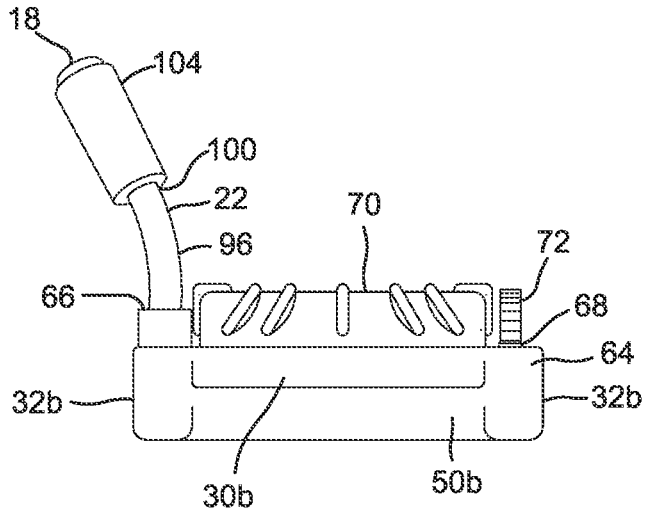
FIG. 13 is a side view of the second arm unit.
Figure 14:
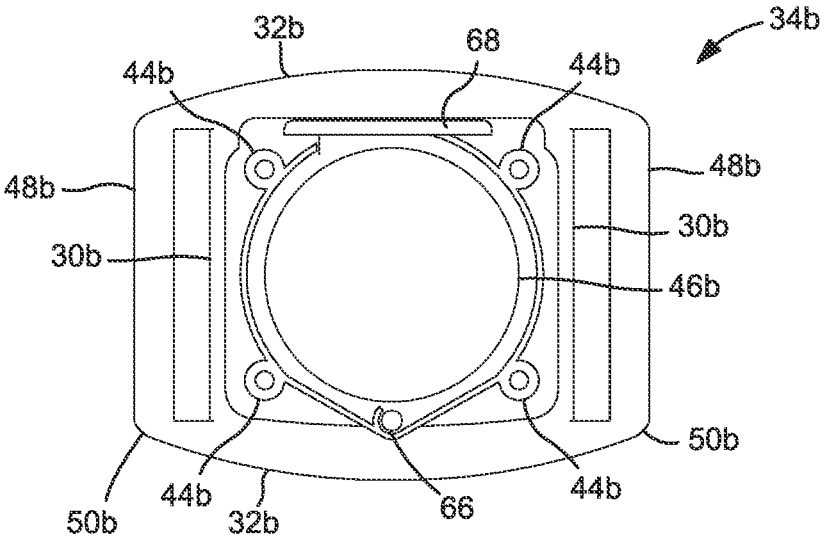
FIG. 14 is a rear plan view of the housing frame included in the second housing shown in FIG. 10.
Figure 15:
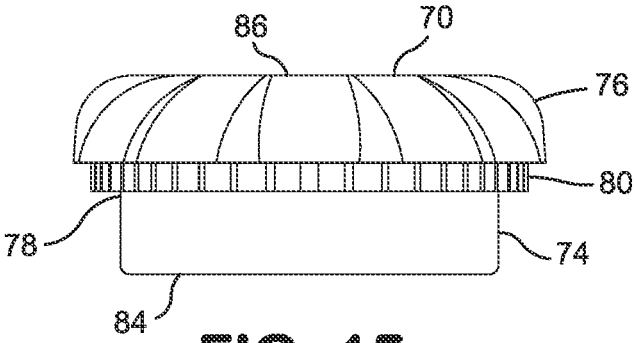
FIG. 15 is an elevation view of the reel included in the second housing shown in FIG. 10.
Figure 16:
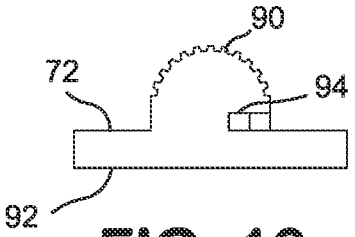
FIG. 16 is an elevation view of the rotation lock included in the second housing shown in FIG. 10.
Figure 17:
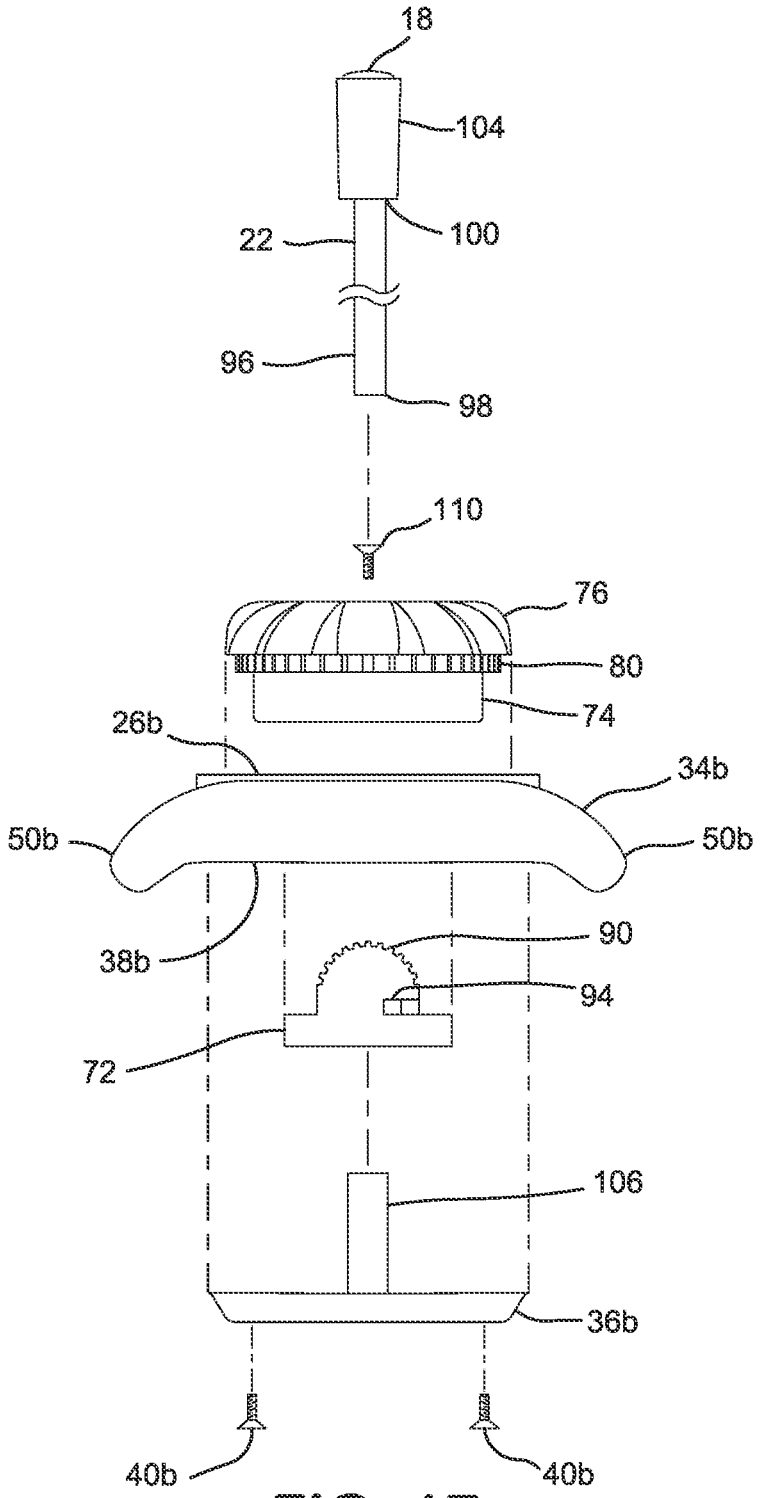
FIG. 17 is an exploded view of the second housing shown in FIG. 10.

An arm position monitor is disclosed herein that alerts a user wearing the device while swinging a golf club when the position of the user's arm deviates from an optimal arm position. The arm position monitor includes first and second arm couplers, a magnetically attractive object, a magnet and a magnet-coupler connector. The first arm coupler is adapted to couple with an arm of the user and the second arm coupler is adapted to couple with the same arm of the user as the first arm coupler or with the other arm of the user. The magnetically attractive object is connected to the first arm coupler. As such, the magnetically attractive object is correspondingly connected to an arm of the user when the first arm coupler is coupled therewith. The magnet-coupler connector extends between the magnet and the second arm coupler. One end of the magnet-coupler connector is connected to the second arm coupler and the other end of the magnet-coupler connector is connected to the magnet. Accordingly, when the second arm coupler is coupled with a respective arm of the user, the magnet-coupler connector connects the magnet to that same arm. The term "connect" as used herein encompasses indirectly linking two structural elements together by means of one or more intervening linking elements or physically engaging two structural elements and directly attaching them together without any other intervening linking elements.

The distance between the magnet and second arm coupler substantially corresponds to the length of the magnet-coupler connector. The magnet has a magnetic attraction force and is adapted to releasably attach to the magnetically attractive object when the arms of the user are in an optimal arm position for a golf swing which positions the magnet and magnetically attractive object adjacent to one another. The magnet is further adapted to detach from the magnetically attractive object when a detachment force greater than the magnetic attraction force is applied to the magnet or to the magnetically attractive object in a direction away from that of the magnetic attraction force which occurs when the arm of the user substantially deviates from the optimal arm position.

In accordance with one preferred embodiment, the arm position monitor comprises two arm units that are coupleable with opposite arms of the user and function in cooperation with one another. A preferred first arm unit is shown in FIGS. 1-8 and generally designated 10. A preferred second arm unit is shown in FIGS. 9-17 and generally designated 12. A magnetically attractive object 14 and first arm coupler 16 are associated with the first arm unit 10 and a magnet 18, second arm coupler 20 and magnet-coupler connector 22 are associated with the second arm unit 12.

A first arm unit housing 24 constructed from a durable hard rigid molded plastic is also associated with the first arm unit 10. The first arm unit housing 24 has an external configuration approximating a rectangular cuboid that encloses a hollow interior. A rectangular cuboid by definition has six external faces each of which is a planar rectangle. In accordance with this definition, the six external faces of the first housing 24 are a front face, a rear face and two pairs of opposing lateral faces. The terms "front" and "rear" are used herein as relative positional terms with reference to the arm unit and the user's arm with which the arm unit is coupled. A "rear" element of a given arm unit is positioned more proximal to and faces toward the user's arm while a "front" element of the same arm unit is positioned more distal to and faces away from the user's arm. A "rearward" direction is toward the user's arm and a "forward" direction is away from the user's arm.

The front and rear faces 26*a*, 28*a* are oriented substantially parallel to one another on opposite sides of the first housing 24 from one another. The opposing lateral faces of the first pair are identical to one another and, as such, each face is identified by the same reference character 30*a*. The opposing lateral faces 30*a* are oriented substantially parallel to one another on opposite sides of the first housing 24 from one another and are oriented substantially perpendicular to the opposing front and rear faces 26*a*, 28*a*. The opposing lateral faces of the second pair are likewise identical to one another and, as such, each face is identified by the same reference character 32*a*. The opposing lateral faces 32*a* are oriented substantially parallel to one another on opposite sides of the first housing 24 from one another and are oriented substantially perpendicular to the opposing front and rear faces 26*a*, 28*a* and to the opposing lateral faces 30*a*. All four lateral faces 30*a*, 32*a* have a slat-like configuration with a narrow width and an elongated length. The front and rear faces 26*a*, 28*a* have the same length as the lateral faces 30*a*, 32*a*, but are substantially wider, thereby having a nearly square configuration.

The first housing 24 is made up of two discrete elements, i.e., a housing frame 34*a* and a rear panel 36*a*, that are joined together to form the unitary first housing 24. The housing frame 34*a* has an open rear side 38*a*, but when the rear panel 36*a* is affixed to the housing frame 34*a*, it fully covers the open rear side 38*a*. The rear panel 36*a* is preferably maintained in place over the open rear side 38*a* at all times during operation of the first arm unit 10. However, the housing frame 34*a* and rear panel 36*a* are preferably joined together by selectively releasable fasteners. As a result the rear panel 36*a* can be removed from the first housing 24 during non-operation of the first arm unit 10 whenever the user desires to access the interior of the first housing 24. In the present embodiment, the rear panel 36*a* is releasably fastened to the housing frame 34*a* by means of a plurality of screws 40*a* and a corresponding number of fastener holes 42*a* extending through the rear panel 36*a* and cooperative cylindrical fastener mounts 44*a* integrally formed in the housing frame 34*a*. Releasable fastening is effected by positioning the rear panel 36*a* over the open rear side 38*a* so that the fastener holes 42*a* are aligned with the fastener mounts 44*a*. Each screw 40*a* is inserted through a respective fastener hole 42*a* and threaded into an aligned fastener mount 44*a*.

It is apparent that the outer surface of the rear panel 36*a* and the rear face 28*a* of the first housing 24 are one and the same, the lateral sides of the housing frame 34*a* and the opposing lateral faces 30*a*, 32*a* of the first housing 24 are one and the same and the front side of the housing frame 34*a* and front face 26*a* of the first housing 24 are one and the same. The substantially continuous surface of the front face 26*a* is interrupted by a front opening 46*a* that is centrally positioned and extends through the entirety of the front face 26*a*. A generally U-shaped bracket 48*a* extends from each opposing lateral face 30*a* in substantially parallel alignment with the opposing front and rear faces 26*a*, 28*a*. The bracket 48*a*, in cooperation with the respective opposing lateral face 30*a* from which it extends, form a strap retention loop 50*a* on each opposite side of the first housing 24.

The first arm coupler 16 is a first coupling strap having a length sufficient to encircle the arm of the user and a width sized to pass through the strap retention loops 50*a* without crimping or folding. The first coupling strap 16 is preferably a two-ended strip of pliant non-stretchable fabric. Each end of the first coupling strap 16 has a plurality of hooks integral therewith while the remaining surfaces of the first coupling strap 16 have a plurality loops integral therewith that cooperatively form a hook and loop fastener.

The first housing 24 encases the electronics of the arm position monitor. Accordingly, the first arm unit 10 is characterized as an electronic device. The electronics are incorporated into a printed circuit board 52 that fits into the hollow interior of the first housing 24. The printed circuit board 52 embodies a microcircuit that has inter alia a magnetic field detector 54, an alarm element 56 and associated operational circuitry including a microprocessor. All the components of the microcircuit are electrically interconnected by means of the printed circuit board 52. The electronics are powered by a small watch-size disc-shaped battery 58 that is maintained in electrical contact with the printed circuit board 52 by means of a battery holder 60 attached to the printed circuit board 52. The battery holder 60 is preferably a sleeve having a slit in its side to receive the battery 58. All the electronics retained in the first housing 24 preferably remain static relative to one another during operation of the first arm unit 10.

The magnetically attractive object 14 is also retained by the first housing 24 which is alternately termed a magnetically attractive object housing. A preferred such object 14 is a solid sphere resembling a ball bearing that is formed from a ferro magnetic metal. A front portion of the magnetically attractive object 14 is exposed to the exterior of the first housing 24 via the front opening 46*a*. This portion is termed the exposed portion. The front opening 46*a* is preferably circular and has a diameter somewhat less than that of the magnetically attractive object 14 to prevent the entire magnetically attractive object 14 from passing through the front opening 46*a*. A similarly sized circular opening 62 is centrally provided in the printed circuit board 52. The opening 62 is aligned with the front opening 46*a* and receives a rear portion of the magnetically attractive object 14 therein, thereby preventing the magnetically attractive object 14 from moving around within the interior of the first housing 24.

Referring to FIGS. 9-17, the second arm unit 12 includes a second housing 64 in addition to the magnet 18, second arm coupler 20, and magnet-coupler connector 22. The second housing 64 is alternately termed a connector housing, but is substantially similar to the first housing 24 insofar as both have substantially the same dimensions and configuration and both are constructed in substantially the same manner from substantially the same materials. As such, elements of the first and second housings 24, 64 that correspond to one another are identified by the same reference characters except that "a" is appended to the reference characters for elements associated with the first housing 24 and "b" is appended to the reference characters for elements associated with the second housing 64.

Like the first housing 24, the second housing 64 is configured in the manner of a rectangular cuboid having a front face 26*b*, a rear face 28*b* and two pairs of opposing lateral faces 30*b*, 32*b*. The second housing 64 is made up of a housing frame 34*b* and rear panel 36*b* that are joined together to form the unitary second housing 64. The rear panel 36*b* fully covers the open rear side 38*b* of the housing frame 34*b* when it is releasably fastened thereto. Releasable fastening is enabled by screws 40*b*, fastener holes 42*b* and fastener mounts 44*b* which permit selective access to the interior of the second housing 64 whenever desired during non-operation of the second arm unit 12. The outer surface of the rear panel 36*b* and the rear face 28*b* of the second housing 64 are one and the same, the lateral sides of the housing frame 34*b* and opposing lateral faces 30*b*, 32*b* of the second housing 64 are one and the same and the front side of the housing frame 34*b* and front face 26*b* of the second housing 64 are one and the same. The continuous surface of the front face 26*b* of the second housing 64 is interrupted by a front opening 46*b* and additionally by an eyelet 66 and a slot 68, all of which extend through the entirety of the front face 26*b*. The front opening 46*b* is centrally positioned on the front face 26*b* while the eyelet 66 is positioned to one side of the front opening 46*b* and the slot 68 is positioned to the opposite side of the front opening 46*b* from the eyelet 66. The second housing 64 has brackets 48*b* and strap retention loops 50*b* that correspond to those of the first housing 24.

The second arm coupler 20 of the second arm unit 12 is a second coupling strap that is identical to the first coupling strap 16 of the first arm unit 10. It is apparent from the above description that the exterior of the first and second arm units 10, 12 each generally resembles the exterior of a conventional wristwatch with the first and second housings 24, 64 each resembling a wristwatch case and the first and second coupling straps 16, 20 each resembling a watch band.

The second arm unit 12 is characterized as a mechanical device because it has several mechanical parts that are movable relative to one another during operation of the arm position monitor. The second arm unit 12 includes a reel 70 and a rotation lock 72 both preferably constructed from a rigid plastic and more preferably from the same rigid plastic as that of the second housing 64. The reel 70 comprises a cylinder 74 and a knob 76 integrally formed therewith to resemble a mushroom with the cylinder 74 resembling a stem and the knob 76 resembling a cap. Accordingly, the knob 76 expands laterally outward from the front end 78 of the cylinder 74 orthogonal to the axis of rotation of the reel 70. A plurality of cogs 80 are provided around the circumference of the front end 78 of the cylinder 74. The reel 70 has an open central cavity 82 extending along the axis of rotation between the rear end 84 of the cylinder 74 and the front end 86 of the knob 76. The central cavity 82 has a small lip 88 at the front end 86 of the knob 76 that slightly reduces its diameter thereat.

The rotation lock 72 is a flat tab having a relatively narrow front end 90 that is narrower than the length of the slot 68 and has a relatively wide rear end 92 that is wider than the length of the slot 68. A tooth-shaped stop 94 is positioned midway between the front and rear ends 90, 92. The stop 94 extends orthogonally away from the lateral face of the rotation lock 72 by a distance that exceeds the width of the slot 68 and is sized to fit between the cogs 80 around the front end 78 of the cylinder 74.

The second arm unit 12 also includes a line 96 that is preferably a pliant, substantially non-stretchable cord having an internal end 98 and an external end 100. The line 96 is divided into two line segments, i.e., an internal line segment 102 that includes the internal end 98 and an external line segment that includes the external end 100. The external line segment is one and the same as the aforementioned magnet-coupler connector 22 of the present embodiment. Accordingly, the terms "external line segment" and "magnet-coupler connector" are synonymous and interchangeable herein with reference to the present embodiment. The magnet 18 is preferably a permanent magnet that is fixably attached to the external end 100 of the line 90 by a shroud 104 which is itself non-magnetic and is preferably plastic. The shroud 104 wraps around the cylindrical lateral face of the magnet 18, but does not prevent the flat front face of the magnet 18 from being exposed to the external environment. A cylindrical shaft 106 is integrally formed on the inside face of the rear panel 36*b* and extends orthogonally from the center of the rear panel 36*b* in a forward direction.

The second arm unit 12 is assembled by forwardly inserting the front end 90 of the rotation lock 72 through the slot 68 so that the front end 90 extends forwardly away from the front face 26*b* external to the second housing 64 and is manually accessible to a user. The rear end 92 and orthogonally oriented stop 94 are sized to prevent them from exiting the interior of the second housing 64 via the slot 68. As a result, the front end 90 is free to slide in a linear back and forth direction within the slot 68 that is orthogonal to the axis of rotation of the reel 70 and the rear end 92 and stop 94 likewise move back and forth within the second housing 64 in correspondence with the front end 90. When the front end 90 comes into abutment with one end of the slot 68, the rotation lock 72 is in the locked position with the stop 94 engaging a cog 80 and when the front end 90 comes into abutment with the opposite end of the slot 68, the rotation lock 72 is in the unlocked position with the stop 94 disengaged from the cogs 80. Once the rotation lock 72 is in place, the rear end 84 of the cylinder 74 is rearwardly inserted into the front opening 46*b* in the housing frame 34*b*. The front opening 46*b* has a slightly larger diameter than the cylinder 74 so that the cylinder 74 is rotatable therein. However, the front opening 46*b* has a smaller diameter than the knob 76 so that the knob 76 covers the circular edge of the front opening 46*b* and is prevented from entering the interior of the second housing 64. Consequently, the knob 76 remains external to the second housing 64 and manually accessible to a user, while the cylinder 74 is internal to the second housing 64.

The internal end 98 of the line 90 is rearwardly threaded through the eyelet 66 in the housing frame 34*b* and extends into the interior of the second housing 64. The internal line segment 102 likewise follows the internal end 98 rearwardly through the eyelet 66 into the interior of the second housing 64 while the magnet-coupler connector 22 remains on the exterior of the second housing 64. The internal end 98 is anchored to the cylinder 74, preferably by press fitting the internal end 98 into a notch 108 formed in the wall of the cylinder 74, while the internal line segment 102 drawn through the eyelet 66 is coiled around the cylinder 74. Thereafter, the rear panel 36*b* is positioned over the open rear side 38*b* of the housing frame 34*b* and the shaft 106, which has a diameter slightly smaller than that of the central cavity 82, is inserted into the central cavity 82. The rear panel 36*b* is secured to the housing frame 34*b* with the reel 70 concentrically mounted on the shaft 106 by forwardly passing the screws 40*b* through the fastener holes 42*b* in the rear panel 36*b* and threading them into the fastener mounts 44*b* in the housing frame 34*b*. An additional releasable fastener 110, preferably a screw, is rearwardly inserted into the central cavity 82 and threaded into the front end of the shaft 106 with the head of the screw 110 resting against the lip 88 external to the second housing 64. As a result, the reel 70 is rotatable about the shaft 106 while the shaft 106 remains fixed relative to the second housing 64.

Figure 18:
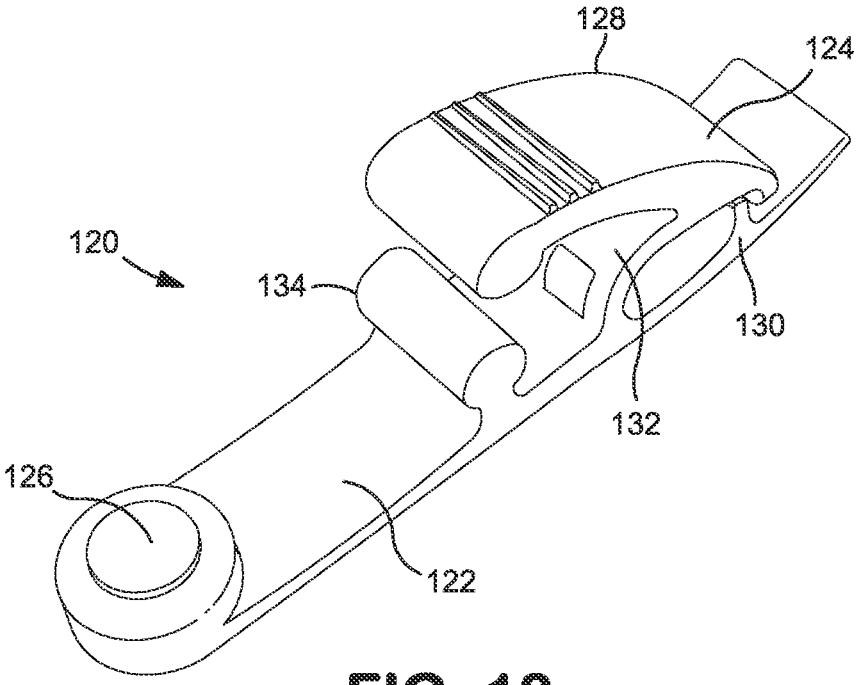
FIG. 18 is a rear perspective view of a wrist bridge having utility in an alternate embodiment of the arm position monitor.
Figure 19:
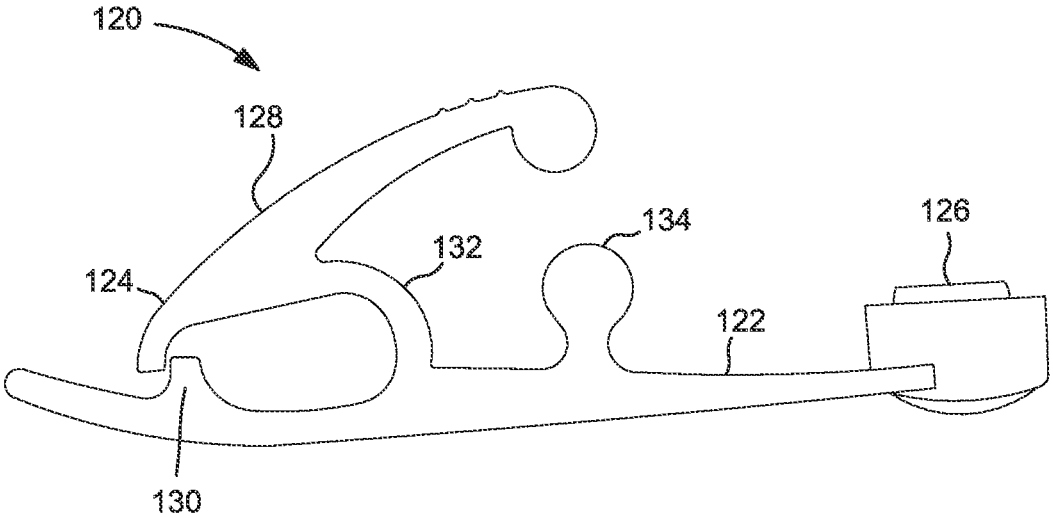
FIG. 19 is an elevation view of the wrist bridge shown in FIG. 18.

Referring to FIGS. 18 and 19, an alternate embodiment of the arm position monitor has an arm unit that is identical to the first arm unit 10 of the embodiment described above and is accordingly identified by the same reference character 10. However, the second arm unit 12 of the above-described embodiment is excluded from the alternate embodiment and replaced by a wrist bridge 120. The wrist bridge 120 comprises a magnet-coupler connector 122, a second arm coupler 124 and a magnet 126. The magnet 126 of the wrist unit 120 is identical to the magnet 18 of the second arm unit 12 in the previous embodiment. However, the magnet-coupler connector 122 and second arm coupler 124 of the wrist bridge 120 are substantially different than the magnet-coupler connector 22 and second arm coupler 20 of the second arm unit 12, respectively. The magnet-coupler connector 122 is a thickened substantially rigid bar having two ends. The second arm coupler 124 is preferably integrally formed with one end of the magnet-coupler connector 122 by molding a high-strength plastic into a unitary structure. The second arm coupler 124 is preferably a clip having two opposing jaws 128, 130 that are biased closed against one another by a leaf spring 132, thereby resembling an alligator clip. The clip 124 also includes a stop 134 to prevent the jaws 128, 130 from opening too wide and damaging the clip 124. The magnet 126 is fixably embedded in the opposite end of the magnet-coupler connector 122 from the second arm coupler 124.

Operation of the Multiple Embodiments of the Arm Position Monitor

The above-described embodiment of the arm position monitor having two arm units 10, 12 is set up for operation by coupling either of the arm units with one arm of the user and coupling other arm unit with the opposite arm using the coupling straps 16, 20. Coupling the arm units 10, 12 with their respective arms is initiated by passing one end of the coupling strap 16, 20 through one of the strap retention loops 50*a*, 50*b* doubling the end back over itself and engaging the hooks and loops of the coupling straps 16, 20 with one another, thereby removably connecting one end of the coupling strap 16, 20 to the strap retention loop 50*a*, 50*b*. Coupling is completed by placing the rear face 28*a*, 28*b* of the housing 24, 64 against the respective arm of the user at a desired coupling location and tightly wrapping the remaining free end of the coupling strap 16, 20 around the respective arm until the free end reaches the opposite strap retention loop 50*a*, 50*b*. The user connects this end of the coupling strap 16, 20 to the opposite strap retention loop 50*a*, 50*b* in the same manner as the first end. The coupling strap 16, 20 is sufficiently taut around the user's arm that the housing 24 resists linear displacement along the length of the arm and resists rotational displacement about the longitudinal axis of the arm during operation of the arm position monitor.

A preferred placement position of the arm units 10, 12 is on the lower arms of the user with each of the first and second arm units 10, 12 positioned at the same point between the wrist and elbow on their respective lower arms. Accordingly, the properly positioned arm units 10, 12 reside in substantially the same horizontal plane and the front faces

26*a*, 26*b* of the respective first and second housings 24, 64 face one another when the user's arms are in the address position of a golf swing.

During set-up the magnet-coupler connector 22 is external to the second housing 64 and hangs freely in an unfettered state with the magnet 18 attached to the external end 100 while the internal line segment 102 is internal to the second housing 64 with the internal end 98 attached to the cylinder 74 and the remainder wound around the cylinder 74. The user assesses the distance between the user's arms along the horizontal plane in which the first and second arm units 10, 12 reside while the arms are in the address position. This distance is termed the optimal arm separation distance. With the front end 90 of the rotation lock 72 abutting the end of the slot 68 corresponding to the unlocked position the user adjusts the lengths of the internal line segment 102 and magnet-coupler connector 22 with reference to the optimal arm separation distance assessed by the user. If the magnet-coupler connector 22 is too short relative to the optimal arm separation distance, the connector length is increased by grasping and manually pulling the magnet 18 forward, thereby rotating the reel 70 in a direction that unspools a length of the internal line segment 102 from the reel 70 and feeds it out of the second housing 64 via the eyelet 66. This action correspondingly decreases the internal line segment length. Alternatively, if the magnet-coupler connector 22 is too long relative to the optimal arm separation distance, the connector length is decreased by manually turning the knob 76 to rotate the reel 70 in an opposite direction that draws a length of the line 90 into the second housing 64 via the eyelet 66 and spools it onto the reel 70, thereby correspondingly increasing the internal line segment length. It is understood that the term "connector length" as used herein includes the fixed length of the magnet 18 in addition to the length of the magnet-coupler connector 22.

The connector length is desirably selected so that it is about equal to the optimal arm separation distance. The term "about equal to" as used herein with reference to the selected connector length encompasses selected connector lengths that have about 1 to 2 inches of slack in them when the magnetically attractive object 14 and magnetic 18 engage one another to accommodate a certain degree of normal acceptable distance changes between the arms during the swing. Thus, the user can effectively control the sensitivity of the arm position monitor by simple adjustments thereof. For example, sensitivity can be decreased by increasing the connector length so that there is more slack in the magnet-coupler connector 22. Conversely, sensitivity can be increased by decreasing the connector length so that there is less slack in the magnet-coupler connector 22. Alternatively, the sensitivity of the arm position monitor can be varied by varying the placement position of the arm units 10, 12 on the opposing lower arms. The arm position monitor is least sensitive when the first and second arm units 10, 12 are placed just above the opposite wrists and most sensitive when the first and second arm units 10, 12 are placed just below the opposite elbows. As such, sensitivity increases as the placement position moves up the opposing lower arms from the user's wrist toward the elbow and correspondingly decreases as the placement position moves down the opposing lower arms from the user's elbow toward the wrist.

In any case, once a desired connector length is selected, the user locks the reel 70 from further rotation by manually sliding the front end 90 of the rotation lock 72 away from the unlocked position until the front end 90 abuts the opposite end of the slot 68 that corresponds to the locked position, thereby pressing the stop 94 of the rotation lock 72 against a cog 80 on the cylinder 74 to prevent the reel 70 from rotating. Accordingly, locking the reel 70 from further rotation at this point desirably sets the selected connector length, termed the optimal connector length, at a length that corresponds to the optimal arm separation distance.

Figure 20:
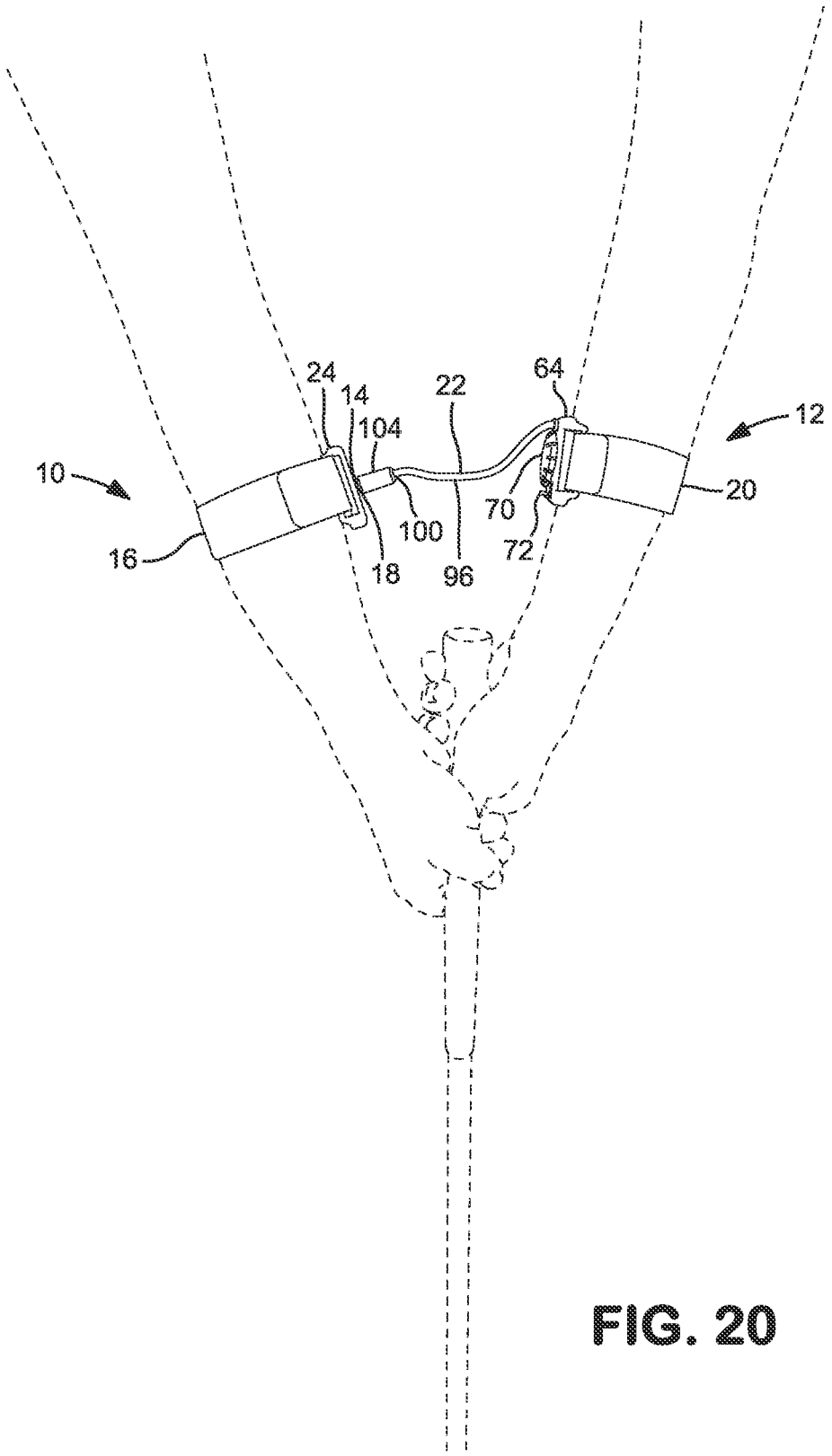
FIG. 20 is a front elevation view of a user's arms having the arm position monitor of the first embodiment coupled therewith, wherein the user's arms are positioned at an optimal arm separation distance at the address stage of a golf shot, thereby enabling a magnet of the second arm unit to engage a magnetically attractive object of the first arm unit.
Figure 21:
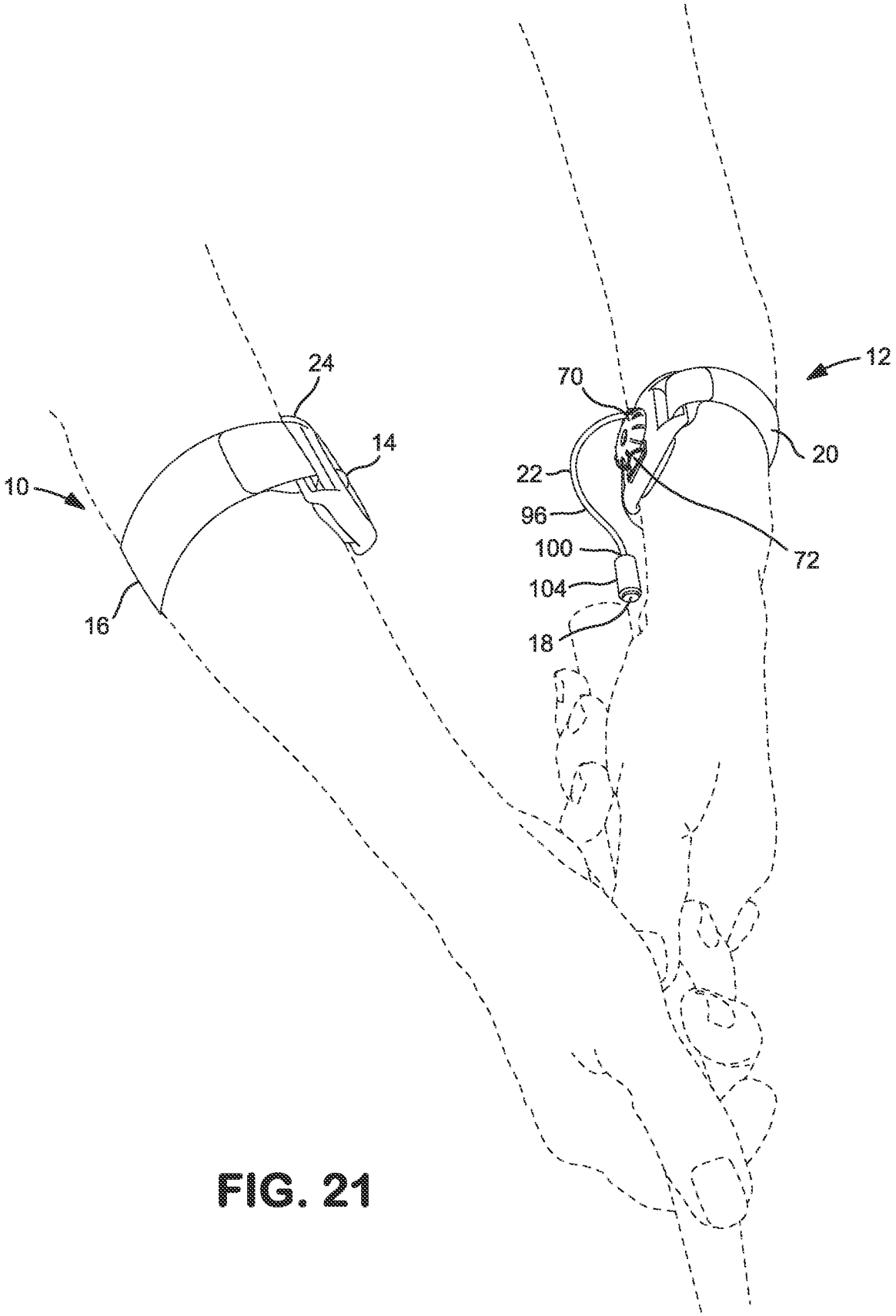
FIG. 21 is a front elevation view of a user's arms having the arm position monitor of the first embodiment coupled therewith, wherein the user's arms are positioned at an actual arm separation distance that substantially exceeds the optimal arm separation distance at the impact stage of a golf shot, thereby causing the magnet of the second arm unit to disengage from the magnetically attractive object of the first arm unit.

The user activates the microcircuit, which is effectively dormant up to this point, by placing the magnet 18 on the second arm unit 12 against the exposed front portion of the magnetically attractive object 14 on the first arm unit 10 so that the magnetic attraction force between them maintains them in engagement with one another as shown in FIG. 20. With the rotation lock 72 still in the locked position, the user performs a golf swing with the desired objective of maintaining the optimal arm separation distance throughout the swing. If at any point during the golf swing, however, the distance between the user's lower arms undesirably substantially increases (i.e., about 1 or 2 inches) beyond the optimal arm separation distance, a separation force is exerted on the line 90 that overcomes the magnetic attraction force between the magnetically attractive object 14 and the magnet 18 and causes them to separate as shown in FIG. 21.

When the magnet 18 separates from the magnetically attractive object 14, there is no longer a magnetic field near the first arm unit 10. The absence of a magnetic field is detected by the magnetic field detector 60 of the microcircuit and the microcircuit sends an activation signal to the alarm element 56. The alarm element 56 emits an alarm in response to the activation signal alerting the user that the user's arms are improperly positioned because the optimal arm separation distance has been substantially exceeded. One preferred alarm is a brief, but noticeable, audible beep sound. However, other alarms such as a vibration or visible light are alternately within the scope of the present invention. In any case, upon detection of the alarm, the user can take steps to correct the improper relative arm positioning. If the user does not detect an alarm from the alarm element 56 during the golf swing, it is confirmation that the user has desirably maintained the actual arm separation distance at the optimal arm separation distance throughout the swing. In some cases, the magnet 18 and magnetically attractive object 14 will disengage at the very end of a full swing even though the swing is entirely proper, thereby causing the alarm element 56 to emit an alarm at the very end of the swing. In these cases the alarm can be ignored and no corrective action taken. Regardless, after an alarm is emitted the microcircuit returns to its dormant state until the magnet 18 and magnetically attractive object 14 are re-engaged by the user to re-activate the microcircuit.

Among the advantageous features of the arm position monitor is the ability to adapt the device to different users having different optimal arm separation distances due to body dimension variability among the different users. The optimal connector length is readily increased by unlocking the reel 70, manually pulling on the magnet 18 and/or magnet-coupler connector 22 to unspool more line 90 from the cylinder 74 and relocking the reel 70 when the desired new longer optimal connector length is achieved. Alternatively, the optimal connector length is readily decreased by unlocking the reel 70, manually turning the knob 76 in the opposite direction to spool more line 90 onto the cylinder 74 and relocking the reel 70 when the desired new shorter optimal connector length is achieved.

The alternate embodiment of the arm position monitor having a single arm unit 10 and a wrist bridge 120 is prepared for operation by coupling both the arm unit 10 and wrist bridge 120 with the lead arm of the user. The arm unit 10 is coupled with the lead arm at a placement position slightly above the wrist using the coupling strap 16 in the same manner as described above for the previous embodiment of the arm position monitor. The wrist bridge 120 is coupled with the lead arm using the jaws 128, 130 of the clip 124 to firmly attach the wrist bridge 120 near the edge of a golf glove worn by the user on the lead hand. Most gloves have an elastic wrist band, in which case care is taken to ensure that the opening of the jaws 128, 130 extends beyond the wrist band toward the palm of the hand when the jaws 128, 130 are clamped down onto the glove. Once the jaws 128, 130 close onto the edge of the glove, the biasing force of the spring 130 maintains the wrist bridge 120 securely attached to the glove. When the wrist bridge 120 is properly positioned, the magnet-coupler connector 122 straddles the flexion-extension pivot axis of the user's wrist.

Figure 23:
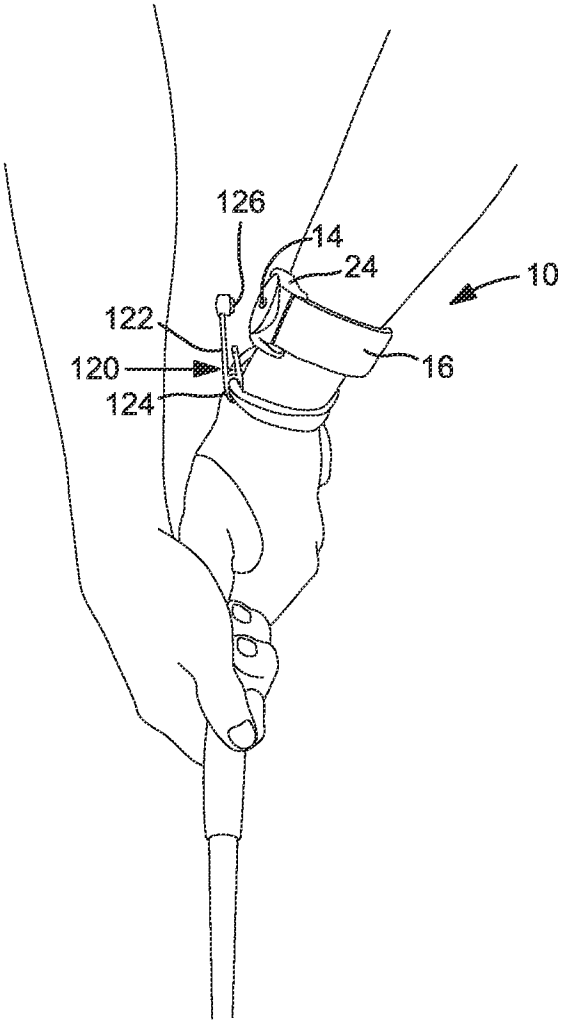
FIG. 23 is a front elevation view of a user having the arm position monitor of the alternate embodiment positioned on the lead arm, wherein the user has deviated from the optimal arm position at the impact stage of a golf shot by cupping the lead wrist, thereby causing the magnet of the second arm unit to disengage from the magnetically attractive object.
Figure 22:
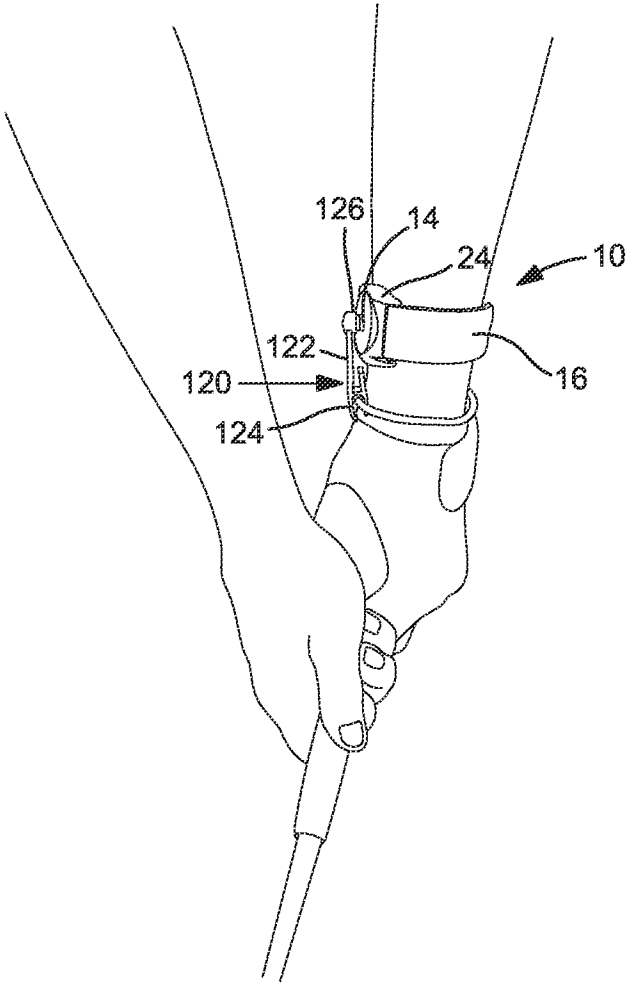
FIG. 22 is a front elevation view of a user having the arm position monitor of the alternate embodiment positioned on the lead arm, wherein the user has an optimal arm position at the impact stage of a golf shot, thereby enabling a magnet to engage a magnetically attractive object.

The connector length of the present embodiment is fixed so that the magnet 126 is positioned adjacent to the exposed front portion of the magnetically attractive object 14 when the arm unit 10 is properly coupled with the lower lead arm of the user. The user activates the microcircuit in the arm unit 10 by placing the magnet 126 against the magnetically attractive object 14 so that the magnetic attraction force between them maintains them in engagement with one another as shown in FIG. 22. The user then performs a golf swing with the desired objective of maintaining the lead wrist uncupped throughout the swing. If at any point during the golf swing, however, the lead wrist cups, a separation force is exerted on the magnet-coupler connector 122 that overcomes the magnetic attraction between the magnetically attractive object 14 and the magnet 126 and causes them to separate as shown in FIG. 23. As a result, the arm unit 10 emits an alarm in the same manner as described above with respect to the previous embodiment of the arm position monitor.

A user can employ any of the above-described embodiments of the arm position monitor while practicing a golf swing at a practice location, e.g., at home or at a practice range, with or without a golf ball. Alternatively, the user can employ any of the embodiments of the arm position monitor while playing an actual round of golf on a golf course.

While the forgoing preferred embodiments of the invention have been described and shown, it is understood that alternatives and modifications, such as those suggested and others, may be made thereto and fall within the scope of the invention. For example, an alternate embodiment of the arm position monitor eliminates the electronics from the arm unit 10 so that no alarm is emitted when the user's arms are improperly positioned. Instead the user is alerted when the user's arms are improperly positioned simply by observing the magnet 18, 126 disconnected from the magnetically attractive object 14. An alternate embodiment of the arm position monitor eliminates the structural elements from the arm unit 12 that enable adjustment of the connector length. Instead, the magnet-coupler connector 22 has a fixed length that is representative of an optimal connector length for a typically sized golfer.

We claim:

1. An arm position monitor comprising:

a magnetically attractive object;

a first arm coupler connected to said magnetically attractive object and adapted to connect said magnetically attractive object to an arm of a user;

a magnet having a magnetic attraction force;

a second arm coupler connected to said magnet and adapted to connect said magnet to the same arm of the user as said magnetically attractive object or to the other arm of the user, wherein said magnet is adapted to releasably attach to said magnetically attractive object when said magnet and said magnetically attractive object are positioned adjacent to one another as a consequence of said magnetic attraction force, said magnet is adapted to remain attached to said magnetically attractive object during a golf swing as long as the arms of the user are maintained in an optimal arm position, and said magnet is adapted to detach from said magnetically attractive object when a detachment force greater than said magnetic attraction force is applied to said magnet or said magnetically attractive object in a direction away from said magnetic attraction force as a consequence of the user substantially deviating from the optimal arm position; and a magnet-coupler connector extending a connector length between said magnet and said second arm coupler, thereby providing a connection between said magnet and said second arm coupler;

wherein said magnet-coupler connector is substantially rigid and said second arm coupler is a clip adapted to attach to a golf glove worn on the hand of the same arm that is connected to said magnetically attractive object, thereby connecting said magnet to the same arm as said magnetically attractive object.

2. The arm position monitor of claim 1, further comprising a magnetically attractive object housing retaining said magnetically attractive object and having a strap retention loop, wherein said first arm coupler is a coupling strap receivable within said strap retention loop and adapted to encircle the arm, thereby connecting said magnetically attractive object to the arm.

3. The arm position monitor of claim 1, further comprising an alarm element adapted to output an alarm when said magnet and said magnetically attractive object detach from one another.

4. The arm position monitor of claim 1, wherein said magnet-coupler connector is an external segment of a substantially pliant non-stretchable line.

5. The arm position monitor of claim 4, wherein said second arm coupler is adapted to connect said magnet to the other arm of the user.

6. The arm position monitor of claim 5, further comprising a connector housing anchoring an end of said magnet-coupler connector and having a strap retention loop, wherein said second arm coupler is a coupling strap receivable within said strap retention loop and adapted to encircle the other arm, thereby connecting said magnet to the other arm.

7. The arm position monitor of claim 6, wherein the arms have an arm separation distance during the golf swing, the optimal arm position corresponds to an optimal arm separation distance, said connector length approximates the optimal arm separation distance, said magnet and said magnetically attractive object attach to one another when the arms are at the optimal arm separation distance and said magnet and said magnetically attractive object detach from one another when the arm separation distance substantially exceeds the optimal arm separation distance.

8. An arm position monitor comprising:

a first arm unit retaining a magnetically attractive object and adapted for connecting to an arm of a user;

a second arm unit including a second arm unit housing adapted for connecting to the other arm of the user;

a line segmented into an internal line segment having an internal end and a magnet-coupler connector having external end, wherein said magnet-coupler connector is maintained external to said second arm unit housing and said internal segment is maintained internal to said second arm unit housing;

a magnet attached to said external end, wherein said magnetically attractive object and said magnet attach to one another due to a magnetic attraction force of said magnet when said magnetically attractive object and said magnet are positioned adjacent to one another;

a reel contained in said second arm unit housing, wherein said internal segment is wound around said reel and said internal end is anchored to said reel; and wherein said internal segment has an internal segment length, said magnet-coupler connector has a connector length, and said connector length is adapted to be set at an optimal connector length approximating an optimal arm separation distance for a golf swing by rotating said reel in one direction to increase said connector length and correspondingly decrease said internal segment length or rotating said reel in an opposite direction to decrease said connector length and correspondingly increase said internal segment length.

9. The arm position monitor of claim 8, wherein said magnetically attractive object and said magnet are adapted to detach from one another when an arm separation distance during the golf swing substantially exceeds said optimal connector length.

10. The arm position monitor of claim 8, wherein said first arm unit has a first arm unit housing retaining said magnetically attractive object and a microcircuit including a magnetic field detector and an alarm element.

11. The arm position monitor of claim 10, wherein said microcircuit is adapted to activate said alarm element when said magnetic field detector detects an absence of a magnetic field proximal to said first arm unit housing due to detachment of said magnetically attractive object and said magnet from one another.

12. The arm position monitor of claim 11, wherein said alarm element is adapted to output an alarm when activated.

13. The arm position monitor of claim 8, further comprising a rotation lock in said second arm unit housing adapted to selectively releasably lock said reel against rotation.

14. The arm position monitor of claim 8, wherein said first arm unit has a first arm unit housing retaining said magnetically attractive object and a first coupling strap engaging said first arm unit housing and adapted to encircle the arm of the user, thereby connecting said magnetically attractive object to the arm, and wherein said second arm unit has a second coupling strap engaging said second arm unit housing and adapted to encircle the other arm of the user, thereby connecting said magnet to the other arm.

15. An arm position monitor comprising:

an arm unit retaining a magnetically attractive object and adapted for connecting to an arm of a user;

a magnet having a magnetic attraction force;

a coupler adapted to attach to a golf glove worn on the hand of the arm that said magnetically attractive object is coupled to; and a substantially rigid magnet-coupler connector extending between and connecting said magnet to said coupler, thereby enabling said coupler to connect said magnet to the arm, wherein said magnet is adapted to releasably attach to said magnetically attractive object when said magnet and said magnetically attractive object are positioned adjacent to one another as a consequence of said magnetic attraction force, said magnet is adapted to remain attached to said magnetically attractive object during a golf swing as long as the arms of the user are maintained in an optimal arm position, and said magnet is adapted to detach from said magnetically attractive object when a detachment force greater than said magnetic attraction force is applied to said magnet or said magnetically attractive object in a direction away from said magnetic attraction force as a consequence of the user substantially deviating from the optimal arm position.

16. The arm position monitor of claim 15, wherein said arm unit has a coupling strap adapted to encircle the arm and an arm unit housing retaining said magnetically attractive object, and wherein said arm unit housing has a strap retention loop receiving said coupling strap, thereby connecting said magnetically attractive object to the arm.

17. The arm position monitor of claim 16, further comprising a microcircuit retained within said arm unit housing and including a magnetic field detector and an alarm element.

18. The arm position monitor of claim 17, wherein said microcircuit is adapted to activate said alarm element when said magnetic field detector detects an absence of a magnetic field proximal to said magnetically attractive object due to detachment of said magnetically attractive object and said magnet from one another.

19. The arm position monitor of claim 18, wherein said alarm element is adapted to output an alarm when activated.

* * * * *